US010130549B2

(12) United States Patent
Balducci

(10) Patent No.: US 10,130,549 B2
(45) Date of Patent: Nov. 20, 2018

(54) PHYSICAL THERAPY BALL

(71) Applicant: Jennifer Balducci, Bowie, MD (US)

(72) Inventor: Jennifer Balducci, Bowie, MD (US)

( * ) Notice: Subject to any disclaimer, the term of this patent is extended or adjusted under 35 U.S.C. 154(b) by 242 days.

(21) Appl. No.: 14/312,370

(22) Filed: Jun. 23, 2014

(65) Prior Publication Data

US 2015/0005683 A1 Jan. 1, 2015

Related U.S. Application Data

(60) Provisional application No. 61/839,826, filed on Jun. 26, 2013.

(51) Int. Cl.
*A61H 15/00* (2006.01)

(52) U.S. Cl.
CPC ..... *A61H 15/00* (2013.01); *A61H 2015/0042* (2013.01); *A61H 2201/0207* (2013.01); *A61H 2201/0214* (2013.01); *A61H 2201/0257* (2013.01); *A61H 2201/1695* (2013.01); *A61H 2205/12* (2013.01)

(58) Field of Classification Search
CPC ..... A61H 7/00; A61H 7/007; A61H 15/00; A61H 2015/0007; A61H 2015/0014; A61H 2015/0028; A61H 2015/0042; A61H 2015/0064; A61H 15/0085; A61H 15/0092; A61H 2201/00; A61H 2201/0153; A61H 2201/0157; A61H 2201/02; A61H 2201/0207; A61H 2201/0214; A61H 2201/169; A61H 2201/1692; A61H 2201/1695; A61H 2201/0257; A61H 2205/12
USPC ..... 601/115, 118, 121, 131, 134, 135
See application file for complete search history.

(56) References Cited

U.S. PATENT DOCUMENTS 744,718 A * 11/1903 Cassidy ..... 473/614
3,037,500 A * 6/1962 Daugherty ..... A61H 15/00 482/79
3,411,498 A * 11/1968 Reiter ..... A61H 7/001 601/131
4,010,743 A 3/1977 Fitzsimons
4,109,649 A * 8/1978 Iyomasa ..... A61H 15/00 601/121
4,191,178 A * 3/1980 Wisnieski ..... A61H 7/001 601/131
4,329,981 A 5/1982 Dungl
4,446,855 A 5/1984 Friedson
4,807,602 A 2/1989 Scarborough et al.
(Continued)

FOREIGN PATENT DOCUMENTS

WO WO00/66065 11/2000

OTHER PUBLICATIONS

Webpage printout from www.footsmart.com (downloaded on Mar. 18, 2012).

(Continued)

*Primary Examiner* — Steven Douglas
(74) *Attorney, Agent, or Firm* — Antoinette G. Giugliano; AGG Intellectual Property Law

(57) ABSTRACT

A physical therapy ball comprises inner and outer hallow spherical bodies. A web positions the inner spherical body with respect to the outer spherical body to form a gap there between. The gap is filled with a high heat capacity gel. An array of conical sections extends from the outer surface of the outer spherical body to facilitate foot massage.

7 Claims, 3 Drawing Sheets

(56) References Cited

U.S. PATENT DOCUMENTS

| | | | | |
|---|---|---|---|---|
| 5,056,507 | A | 10/1991 | Yum | |
| 5,389,063 | A * | 2/1995 | Wu | A61H 7/001 273/153 S |
| 5,411,470 | A | 5/1995 | Liptak et al. | |
| 5,725,484 | A | 3/1998 | Burnham | |
| 5,785,668 | A | 7/1998 | Shimizu | |
| 6,499,485 | B1 * | 12/2002 | Pepera | A61F 7/02 128/845 |
| D478,947 | S * | 8/2003 | Lu | D21/662 |
| 6,866,776 | B2 | 3/2005 | Leason et al. | |
| 7,156,817 | B1 * | 1/2007 | Cassidy Phillips | A61H 15/0092 601/131 |
| 7,399,285 | B2 | 7/2008 | Stein | |
| 7,517,324 | B2 * | 4/2009 | Cohen | A61H 7/001 601/135 |
| D694,421 | S * | 11/2013 | Anderson | D24/215 |
| 2003/0009118 | A1 | 1/2003 | Sabo et al. | |
| 2013/0090583 | A1 * | 4/2013 | Jung | A61H 15/00 601/131 |

OTHER PUBLICATIONS

Webpage printout showing Rhino Balls from www.bodyback.com (downloaded on Mar. 18, 2012).
Webpage printout showing DueNorth® Foot Rubz™ Message Ball from www.surefoot.net (downloaded on Mar. 18, 2012).

* cited by examiner

PHYSICAL THERAPY BALL

RELATED APPLICATION

This application claims the benefit of U.S. Provisional Application No. 61/839,826, filed Jun. 26, 2013.

The entire teachings of the above application are incorporated herein by reference.

BACKGROUND OF THE INVENTION

Many individuals who suffer chronic and acute foot pain such as that caused by plantar fasciitis seek relief by visiting a therapist who performs a number of procedures including a foot massage. Sometimes the therapist instructs the individual to massage his or her foot at home. There are a number of massage devices which aid an individual at home without the therapist being present.

In one basic approach, an individual rolls his or her foot on a spherical device, such as a golf ball or tennis ball, while applying some weight on that foot. An alternative device is a metal massage ball with temperature retention properties so the user can cool the ball prior to use and then roll the ball with the underside of the foot to enhance the massage by cooling the plantar fascia and other portions of the foot that contact the ball.

Several of these massaging devices have at least one or more disadvantages. For example, some do not roll easily in all directions. Some are not easily cleaned and disinfected. Yet others are not ideal for providing deep massage. Still others cannot be cooled prior to use for treating plantar fasciitis for an extended time during therapy. Others are unable to carry an average individual's full weight during massage.

A need exists for a massage device for foot therapy, particularly for massaging the plantar fascia, that has a good size for rolling under the foot with adequate pressure and that is relatively hard and capable of bearing an average person's weight. A further need exists for a massage device that can be easily cleaned and disinfected, has a surface that facilitates a deep massage of the plantar fascia, and is adapted to be cooled.

SUMMARY OF THE INVENTION

The present invention relates to a physical therapy ball that has an integral spherical structure including: i) a hollow outer spherical body having an outer surface, ii) a plurality of spaced protuberances extending radially from and being integral with the outer spherical body, iii) an inner spherical body, and iv) a standoff positioning the inner spherical body in a spaced relationship to the outer spherical body thereby to form a gap therebetween. The physical therapy ball of the present invention further includes a fluid material in the gap for establishing the temperature of the outer body. Examples of the fluid material includes gels such as hydroxyethyl cellulose, elastic gel, non-toxic silica gel, putty, and the like. In an embodiment, the inner spherical body has a volume that is in the range from about 20% to 50% of the internal volume of the outer spherical body. In yet another embodiment, the volume of the gap is in the range from between about 50% to about 80% of the internal volume of the outer spherical body. In some embodiments, the fluid material can occupy spaces (e.g., some volume) within the protuberances (e.g., within one or more of the plurality of spaced protuberances).

In yet another embodiment, the present invention pertains to a physical therapy ball that includes an integral spherical structure including an outer spherical surface and an internally disposed gel material, and a plurality of evenly spaced protuberances extending radially from and integral with the spherical structure. The protuberances can extend from the integral spherical structure to a curved free end. In an embodiment, the protuberances are equiangularly spaced (with respect to the angle formed between a line from the center of one protuberance to the center of the therapy ball and a line from the center of an adjacent protuberance to the center of the therapy ball) by an angle in the range of 10° to 20°, and the centerline distance between each pair of adjacent protuberances is in the range from about 5 mm to about 15 mm.

In yet another embodiment, the physical therapy ball of the present invention includes means for forming a hollow outer spherical body having an outer surface and an inner spherical body disposed concentrically within and spaced from the outer spherical body to form a gap therebetween, a plurality of spaced protuberances extending radially from and being integral with the outer spherical body, and a means between the outer and the inner spherical bodies for establishing the temperature of the outer body.

BRIEF DESCRIPTION OF THE DRAWINGS

The foregoing and other objects, features, and advantages of the invention will be apparent from the following more particular description of preferred embodiments of the invention, as illustrated in the accompanying drawings in which like parts are referred to by the same reference characters across different views. The drawings are not necessarily to scale, emphasis instead being placed on illustrating the principles of the invention.

DETAILED DESCRIPTION OF THE INVENTION

A description of preferred embodiments of the invention follows.

Figure 1:
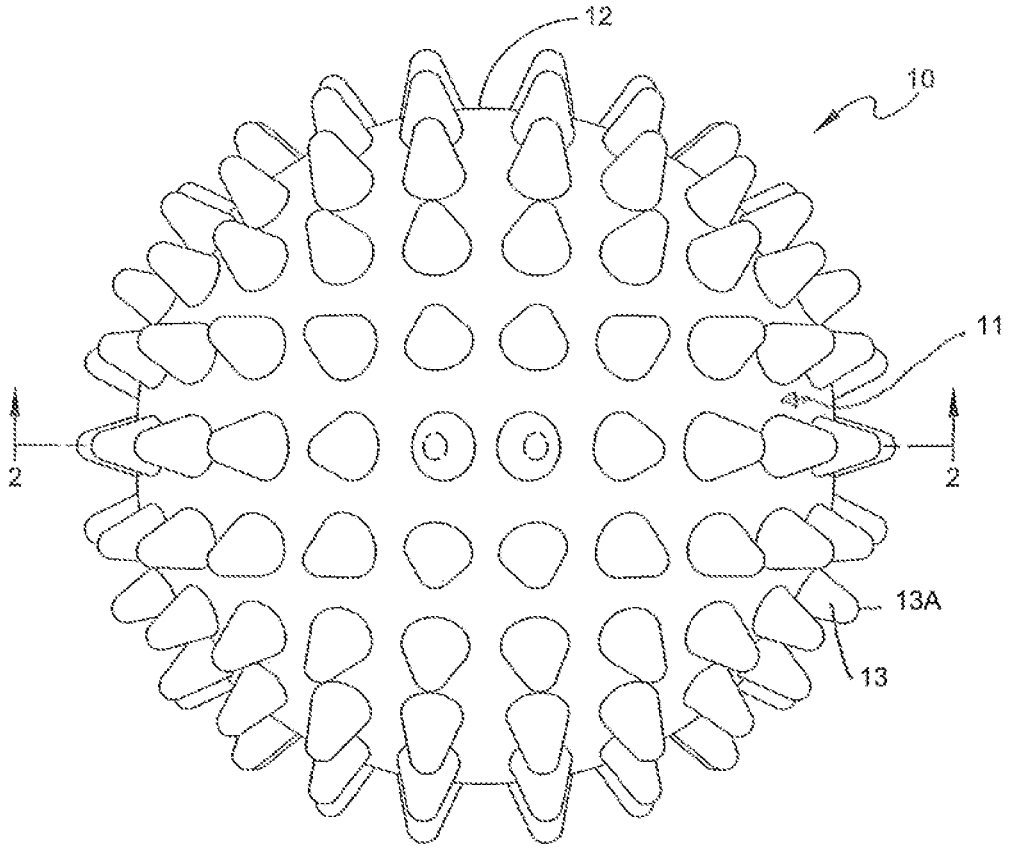
FIG. 1 is a perspective view of a physical therapy ball constructed in accordance with this invention.
Figure 2:
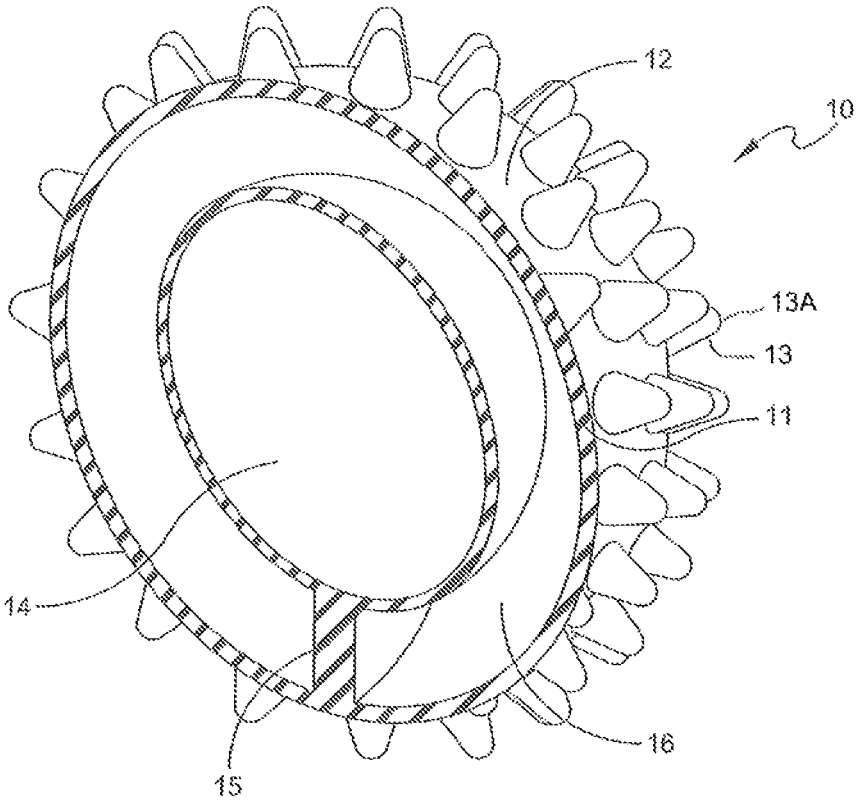
FIG. 2 is an internal isometric view of the construction of the physical therapy ball of FIG. 1 at one stage during the manufacture thereof.

As shown in FIGS. 1 and 2, physical therapy ball 10 that the present invention embodies has a spherical shape defined by outer spherical body 11 with outer surface 12 from which emerges an array of equiangularly spaced, radially extending protuberances in the form of conical structures 13, each having a curved or radiused free end 13A. The modifiers "equiangular" and "equiangularly" are used in this document to refer to the angles that pairs of adjacent protuberances each have with respect to the center of the therapy ball. For example, for any adjacent pair of protuberances (where, the adjacent protuberances are those that have no other protuberance closer to them than their adjacent protuberance in the same direction, although they may have other protuberances that are equally or similarly spaced from them in other directions) an angle would be formed between the two lines that point from each protuberance toward the center of the therapy ball (where the two lines intersect). This angle, for embodiments described as having equiangularly spaced protuberances, would be the same or roughly the same (within 10% or less, such as 5%, or 1%) of for all adjacent pairs of protuberances. In the preferred embodiment, spherical body 11 and conical structures 13 are molded as an integral unit.

A plurality of conical structures exist on the outer surface of the physical therapy ball. When in use, the conical structures provide deep massage and act to break up or reduce the thickness of plantar fascia of foot, and reduce inflammation. The physical therapy ball of the present invention has an inner structure that holds gel along the inside of the outer surface so that the ball can stay cool during use. Additionally the inner structure, further described herein, minimizes the total amount of gel that resides within the ball. Because gel can be heavy, this confers the advantage of making the therapy ball lighter. The inner structure minimizes the amount of gel used in the ball yet at the same time allows for full gel coverage of the inside of the outer structure (e.g., in gap 16) to keep the surface of the outer structure cool during use.

With respect to FIG. 1, a number of conical structures rise out of the outer surface of the physical therapy ball. The size, shape, and spacing of the conical structures allow the physical therapy ball to be effective in breaking up plantar fascia tissue. The conical structures have a height and width to penetrate tissue. Although of a generally conical shape, the conical structures have tips that are rounded so as not to be sharp against the skin. The rounded tip allows penetration into the plantar fascia tissue without piercing the skin. In an aspect, the size of the conical structures have a height of between about 6 mm and 15 mm (e.g., between about 7 mm and about 11 mm), and width of between about 4 mm and about 8 mm. By width, what is referred to is the maximum distance (in Euclidean geometry—through space, and not through the surface of the therapy ball) between two sides of a conical structure, which for most embodiments is at the base of the conical structure where it meets the outer surface of the outer spherical body. For embodiments in which the conical structures have a circular (as opposed to, for example, an elliptical) base, the width would be equivalent to the largest diameter of the conical structure, which would typically be at the base of the conical structure where it meets the outer surface of the outer spherical body. Similarly, the relationship between the conical structures, in relation to one another, allows the physical therapy ball to be effective. For example, the angle between the radii of adjacent conical structures, $\alpha$, can be in a range of about 10° and about 20°, and preferably about 15°. By the term "radii of adjacent conical structures", it is referred to the radii (from the center of the therapy ball) that points in the direction toward the center of the conical structures. The "angle", unless otherwise specified within the context, is the angle between the radii of adjacent conical structures. The angle and distance between the conical structures allow the device to break up the tissue by providing a point of force at a pre-determined spacing and angle. The centerline spacing between the (basal) centers of adjacent conical structures can be in the range from about 6 mm to about 14 mm; a preferred range is about 8 mm to about 12 mm. In one embodiment of the present invention, the spacing was selected to be 10 mm. The term "spacing" refers to the distance between the center of on-the-surface-base of one conical structure (where, on-the-surface-base of a conical structure curves in an overlapping fashion around the outer surface of the outer spherical body) and the analogous center of another conical structure. As such, it is measured between and through the outer surface of the outer spherical body. Thus, the distance measuring line is not necessarily linear in space, even though for close distances it can become approximately linear. The "centerline spacing" refers to this distance between conical structures. In some embodiments, a fluid material (such as a gel) present within the therapy ball can freely access (get into and out of) the inner spaces of protuberances. In other embodiments, the protuberances, or some of them, can be devoid of inner empty space, so as to prevent passage of fluids into their inner spaces (which might make cleaning the therapy ball easier).

FIG. 2 depicts the internal structure of spherical body 11 with outer surface 12 and external conical structures 13. The physical therapy ball has an inner spherical body within the outer spherical body with a space maintained therebetween. More specifically, outer spherical body 11 is a hollow structure and contains a smaller diameter, a space or gap, and inner spherical body 14. Web 15 acts as a standoff to support inner spherical body 14 centrally with respect to outer spherical body 11. The inner surface of outer spherical body 11 and the outer surface of inner spherical body 14 form gap 16. The web maintains the space between the inner and outer spherical bodies. This space is used to hold gel that can be cooled or heated. The inner design allows the gel to maintain a surface area with the inside of the outer spherical body, and minimizes the total amount of gel needed for the device. In some embodiments, there can be more than one web (more than one standoff). In certain embodiments, the web itself can have pores or inner channels so as to allow passage of the gel or other fluid material. In some embodiments, the gap is constructed to have a reduced volume in order to prevent the filling fluid material from rolling to the bottom side of the therapy ball (the bottom side being relative to how the ball is used, as it would change during usage). In other embodiments, the relative volume of the gap is not as important due to usage of higher viscosity fluid materials that completely fill the gap. In many embodiments, the gel inside the gap can be both cooled and heated. In some embodiments, heating can be done by microwaving. In certain embodiments, cooling can be accomplished by placing the therapy ball in a freezer. In many of the embodiments, the therapy ball can be rolled in many directions and is hard enough to withstand the weight of an average person.

The outer spherical body 11 has an internal volume referred to as $V_{outer}$ and the inner spherical body 14 has a volume of $V_{inner}$. Per our definition, for calculation of $V_{outer}$ all structures inside of the outer spherical body are ignored (the outer spherical body is assumed to be empty). The gap in which the gel resides then has a volume that is approximately the difference between that of the internal and outer spherical bodies, e.g., $V_{gap}=V_{outer}-V_{inner}$. This is an approximation, because any volume taken up by the shells of the spherical bodies (e.g., the inner spherical body) and the web need to be subtracted from the volume of the outer body as well. Any sum of volume of individual conical structures that would contribute additional volume that a fluid material can occupy on top of the volume of the outer spherical body also need to be considered. For simplicity and convenience, these three corrections are ignored in this document, but they should be considered for more accurate calculations. The relationship between $V_{gap}$ and $V_{outer}$ is such that the weight of the gel to reside in the gap is reduced, while the gel still maintains contact with the inside of the outer spherical body and/or the conical structures. In an embodiment, the $V_{outer}$ has volume of between about 12 $in^3$ and about 20 $in^3$, and in particular between about 14 $in^3$ and about 18 $in^3$, and a $V_{gap}$ volume between about 8 $in^3$ and about 14 $in^3$, and in particular between about 9 $in^3$ and 13 $in^3$. Similarly, the relationship between $V_{outer}$ and $V_{gap}$ can be expressed as a percentage. In an embodiment, the percent of $V_{gap}$ in relation to $V_{outer}$ ranges between about 50% to about 80%. Consequently, the percent of $V_{inner}$ in relation to $V_{outer}$ ranges between about 20% to about 50%. In one embodiment of this invention, the outer and inner spherical bodies have diameters of between about 2 in and about 4 in, and about, in particular, 1 in and about 3 in, respectively. The difference in diameters between the inner and outer spherical bodies results in a gap having a distance of between about ¼ in and about 1½ inches (e.g., about ½ inch).

Figure 3:
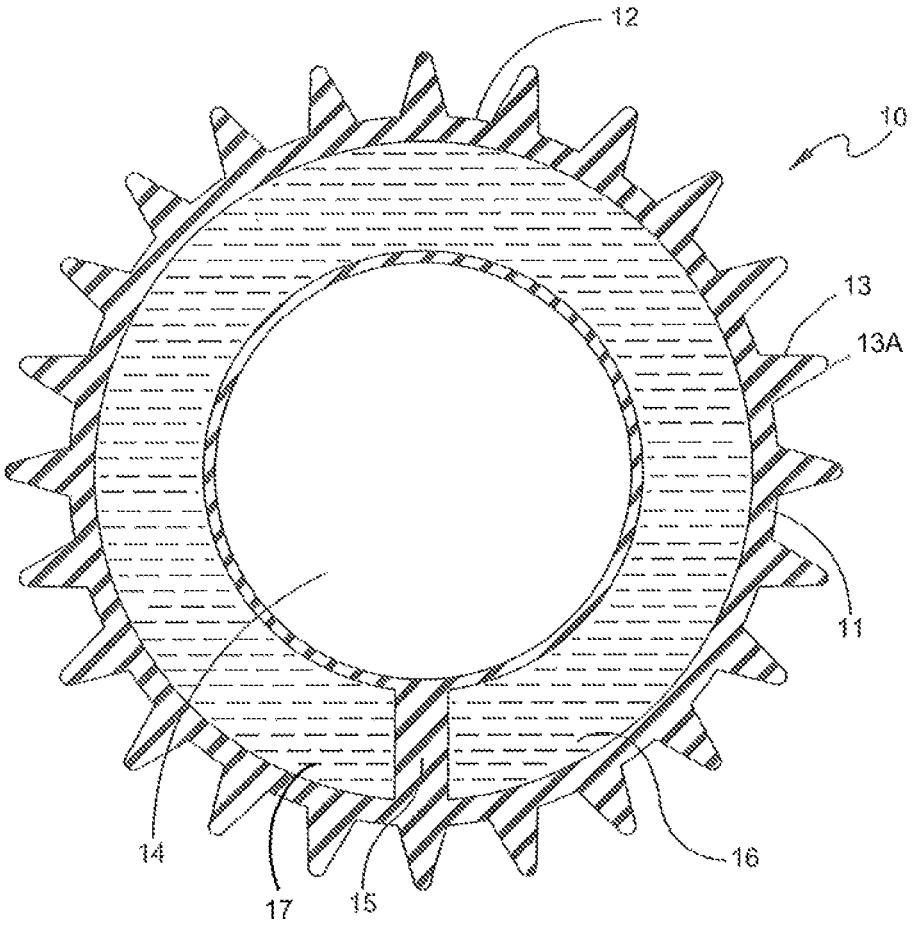
FIG. 3 is a cross section through a completed physical therapy ball of FIG. 1.

As shown in FIG. 3, gap 16 between the outer and inner spherical bodies in finished physical therapy ball 10 is filled with fluid material 17 (e.g., gel). In some embodiments, fluid material 17 can access an inner space of the conical structures, thereby occupying volumes that are outside of the volume of the outer spherical body. The embodiment shown in FIG. 3 has conical structures that are substantially solid (including their interiors); however, other embodiments (not shown) include conical structures that have holes in their bases allowing fluid material 17 to pass into and out of the conical structures, while still other embodiments include conical structures that have bases fully open (e.g., hollow) to receive the fluid material (e.g., the exterior surfaces of conical structures are continuous with the outer spherical body and the inner volumes of conical structures are extensions of the volume of the gap, thereby allowing a smooth flow of fluid material between the inner volumes of the conical structures and the gap). Fluid material 17 can be cooled in a temperature ranging between about −10° C. and about 2° C. Fluid material 17 for use in the present invention should maintain its temperature for at least one use (e.g., between about 1 and 30 minutes and in particular between about 10 minutes and 20 minutes) and resists the thermal conduction in the presence of a thermal gradient. In an embodiment the fluid material is a refrigerant and is non-toxic, and it can absorb a considerable amount of heat. In one embodiment, the fluid material is a gel of hydroxyethyl cellulose, elastic gel, non-toxic silica gel, putty, and the like.

Spherical bodies 11 and 14 can also define a relatively "hard" ball that does not deform significantly under an individual's weight during massage. In some embodiments, at least the material in outer spherical body 11 can withstand repeated cleaning and disinfecting. In addition, the inner spherical body 14 should be able to maintain its shape and volume during use. In one specific embodiment, the outer spherical body, the inner spherical body or both are molded from a plastic material and the like. The materials used to construct the inner spherical body, the outer spherical body, and the web can be all the same or different from each other. In some embodiments, hard unbendable plastics are used for all of the parts.

In use, physical therapy ball 10 as shown in FIG. 1 can be placed in a freezer to cool the entire structure including the gel. Then the individual can manipulate or otherwise contact the cooled physical therapy ball under his or her foot. The high specific heat of some embodiments of fluid material 17 slows the rate of heat transfer from the bottom of the foot into the cooler fluid material 17. This controls the rate at which the surface temperature of outer surface 12 rises, and extends the time for use of therapy ball 10 during which the individual will sense a cool physical therapy ball during a massage.

The present invention involves methods for using the device described herein. The method includes the step of cooling the physical therapy ball to the desired temperature. The method further includes messaging the plantar fascia by placing the ball on the floor and the user placing his/her foot on the physical therapy ball. Using the weight of the individual, the individual rolls the ball back and forth to massage the plantar fascia tissue of the foot. The user massages this tissue for a period between about 1 and 30 minutes (e.g., 5 minutes).

One could change the shape and size of, and the array angular spacing or density of, conical structures 13 about the periphery of surface 11. Specific materials have been described; others could be substituted. Various manufacturing techniques could be adapted to manufacture the therapy ball of this invention. Although depicted as a single solid structure, web 15 could be perforated and multiple webs or equivalent structures could be substituted. All such variations and others could be made without departing from the scope of the invention encompassed by the appended claims.

The conical structures can be distributed on the outer surface of the outer spherical body via various methods. Many mathematical methods are known to distribute points on a sphere. For example, an optimal distribution can be created for a sphere with a desired diameter, if any of the following three is provided by a user: the number of points (for our embodiments, these would be the base-centers of the conical structures), the average distance between the points, or the average angle between the points. The distribution can be created to be uniform, regular, somewhat random, or fully random. Various known symmetries can be employed as well, such as the symmetry of a bucky-ball, or symmetries that derive from icosahedral or dodecahedral symmetries.

Any manufacturing technique known in the art or developed in the future can be used to make the present invention. Exemplary techniques include rotational molding, 3D printing, injection molding (e.g., a single solid piece or two identical pieces), and blow molding. In one manufacturing technique, the structure shown in FIG. 2 is molded and an entrance port is provided (not shown) to allow the introduction of the fluid material 17 into the gap 16 after which the port is closed. In some embodiments, the port includes a puncturable and self-sealing plug. In certain embodiments, the therapy ball is supplied with a prefilled gel that does not need to be changed, so in these embodiments, the therapy ball has no port to replace the fluid material. In other embodiments, the therapy ball is constructed from two semi-spheres (each of which could have half the volume of a full sphere, or one could have less than half the volume and the other more than half the volume) that are attached to each other by screwing their open sides to each other (e.g., they are so constructed that their open sides have helical grooves that allow one to screw onto the other, while after the fastening is completed, the grooves are not visible from the outside surface of the ball). In yet other embodiments, self-sealing properties of the material used for construction of the outer spherical body allow a user to inject a fluid material into (and drain it from) the ball via a syringe.

Exemplification

The physical therapy ball shown in the figures was made as follows. The physical therapy ball made had an overall diameter of about 3.18 in (not including the conical structure), and circumference of about 10 inches. The inner spherical structure had a diameter of about 2.12 in and a volume of about 4.98 $in^3$. The outer spherical structure had a volume of about 16.83 $in^3$. The diameter of the gap between the inner and outer spherical structures was about ½ in and had a volume of about 11.8 $in^3$. The gel used for the physical therapy ball was non-toxic silica gel. The conical structures had a height of about 8 mm and a width of about 5 mm, and are separated from one another by a distance of about 10 mm. The angle between the radii of adjacent conical structures was about 15°.

The relevant teachings of all the references, patents and/or patent applications cited herein are incorporated by reference in their entirety.

While this invention has been particularly shown and described with references to preferred embodiments thereof, it will be understood by those skilled in the art that various changes in form and details may be made therein without departing from the scope of the invention encompassed by the appended claims.

What is claimed is:

1. A physical therapy ball comprising:

A. an outer spherical body having an internal volume and an outer surface, and an inner spherical body disposed concentrically within and spaced with a single standoff from said outer spherical body to form a gap therebetween, wherein said gap has a volume, wherein the single standoff is centrally disposed within the gap and extends radially from said inner spherical body to said outer spherical body;

B. a plurality of equiangularly spaced protuberances extending radially from and being integral with said outer spherical body, wherein the plurality of equiangularly spaced protuberances comprise a plurality of adjacent conical structures that have a height, a width and radii to break up or reduce thickness of a plantar fascia of a user's foot, wherein an angle between the radii of the plurality of adjacent conical structures is between about 10° to about 20°, and C. a fluid material between said outer and said inner spherical bodies for establishing a temperature of said outer body, wherein the plurality of equiangularly spaced protuberances are positioned to break-up or reduce thickness of the plantar fascia of the user's foot, when in use.

2. A physical therapy ball as recited in claim 1, wherein said fluid material is taken from the group consisting of hydroxyethyl cellulose, elastic gel, non-toxic silica gel, and putty.

3. A physical therapy ball as recited in claim 2, wherein said fluid material is hydroxyethyl cellulose.

4. A physical therapy ball as recited in claim 1 wherein the volume of said gap is in the range from about 50% to about 80% of the internal volume of said outer spherical body.

5. A physical therapy ball as recited in 1, wherein the volume of said gap is about 67% of the internal volume of said outer spherical body.

6. A physical therapy ball as recited in claim 1, wherein the outer surface of the outer spherical body has about 150 to about 250 spaced protuberances.

7. A physical therapy ball as recited in claim 6, wherein the outer surface of the outer spherical body has about 200 spaced protuberances.

* * * * *